United States Patent [19]

Upright

[11] 4,081,161

[45] Mar. 28, 1978

[54] HEATER SYSTEM FOR RAILROAD SWITCH

[76] Inventor: Neil Upright, 11825C - 145 St., Edmonton, Alberta, Canada

[21] Appl. No.: 747,339

[22] Filed: Dec. 3, 1976

Related U.S. Application Data

[63] Continuation of Ser. No. 508,347, Sep. 23, 1974, abandoned.

[51] Int. Cl.[2] ..... E01B 7/24

[52] U.S. Cl. ..... 246/428; 104/279

[58] Field of Search ..... 246/428; 104/279; 126/271.1, 271.2 B; 291/43; 37/14, 17, 19

[56] References Cited

U.S. PATENT DOCUMENTS

| | | | |
|---|---|---|---|
| 2,898,062 | 8/1959 | Magnus | 246/428 |
| 3,223,835 | 12/1965 | Cherry et al. | 246/428 |
| 3,312,820 | 4/1967 | Watkins | 246/428 |
| 3,697,746 | 10/1972 | Patterson et al. | 246/428 |

*Primary Examiner*—Trygve M. Blix
*Assistant Examiner*—Charles E. Frankfort
*Attorney, Agent, or Firm*—Millen & White

[57] ABSTRACT

A heater is provided to supply hot air through apertured distribution ducts at a rate of at least 1300 CFM, a temperature of at least 250° F, and a velocity of at least 3000 FPM so as to clear the entire switch area of ice, snow and water. The parallel, spaced distribution ducts are apertured so as to direct the air not only outwardly toward the rails but also inwardly to clear the central portion of the rail grade. The switch grade is therefore kept dry and the movable rails are free to be shifted when required.

9 Claims, 6 Drawing Figures

HEATER SYSTEM FOR RAILROAD SWITCH

This is a continuation, or application Ser. No. 508,347 filed Sept. 23, 1974, now abandoned.

BACKGROUND OF THE INVENTION

This invention relates to a heater system for maintaining railway switches in a freely operating condition and the switch rail bed dry under severe winter conditions. The system provides for effective clearing of ice, snow and accumulated water from the switch area of the railway grade and the ties and rails.

The prior art systems have, in general, relied upon localized heating of the movable rails and melting of the snow and ice between the movable and fixed rails. These systems are subject to failure because pools of water are generated on the central portion of the grade between the rails, thereby creating a soft spot. When the heat is shut off, the water refreezes and there is a gradual buildup of ice which leads to clogging of the duct outlets and interference with the switch movements.

SUMMARY OF THE INVENTION

The present system overcomes the prior art deficiencies by supplying sufficiently large volumes of hot air at sufficiently high velocities so as to melt ice and snow and clear the produced water from the railway switch grade across the entire length of the ties. Preferably, at least about 1300 cubic feet per minute (CFM) of air at a temperature greater than about 250° F and at a pressure in excess of one inch water column is supplied by the heat source and forced out the duct outlets at a velocity in the order of at least 3000 feet per minute (FPM) and dispersed outwardly along the rails and to the ends of the ties and inwardly across the rail bed between the rails. By way of comparison, prior art systems with which I am acquainted have directed hot air at about 100° F at localized areas at rates of about 800 CFM and at a pressure of about 0.3 inches of water column, with the result that the water remains on the rail grade and forms large pools.

The prime object of the present invention is therefore to effectively keep the area of the rail grade dry and free of ice, snow and water during winter.

Another object of the present invention is to provide a system which uses large volumes of high velocity hot air to effectively remove snow, ice and water from the railway grade to allow the effective functioning of the railway switch.

Another object of the present invention is to provide an effective, self-contained, compact, maintenance-free system for clearing railway grades.

Other objects and features of the invention will become apparent from the following disclosure and description of the invention.

DESCRIPTION OF THE PREFERRED EMBODIMENT

Figure 1:
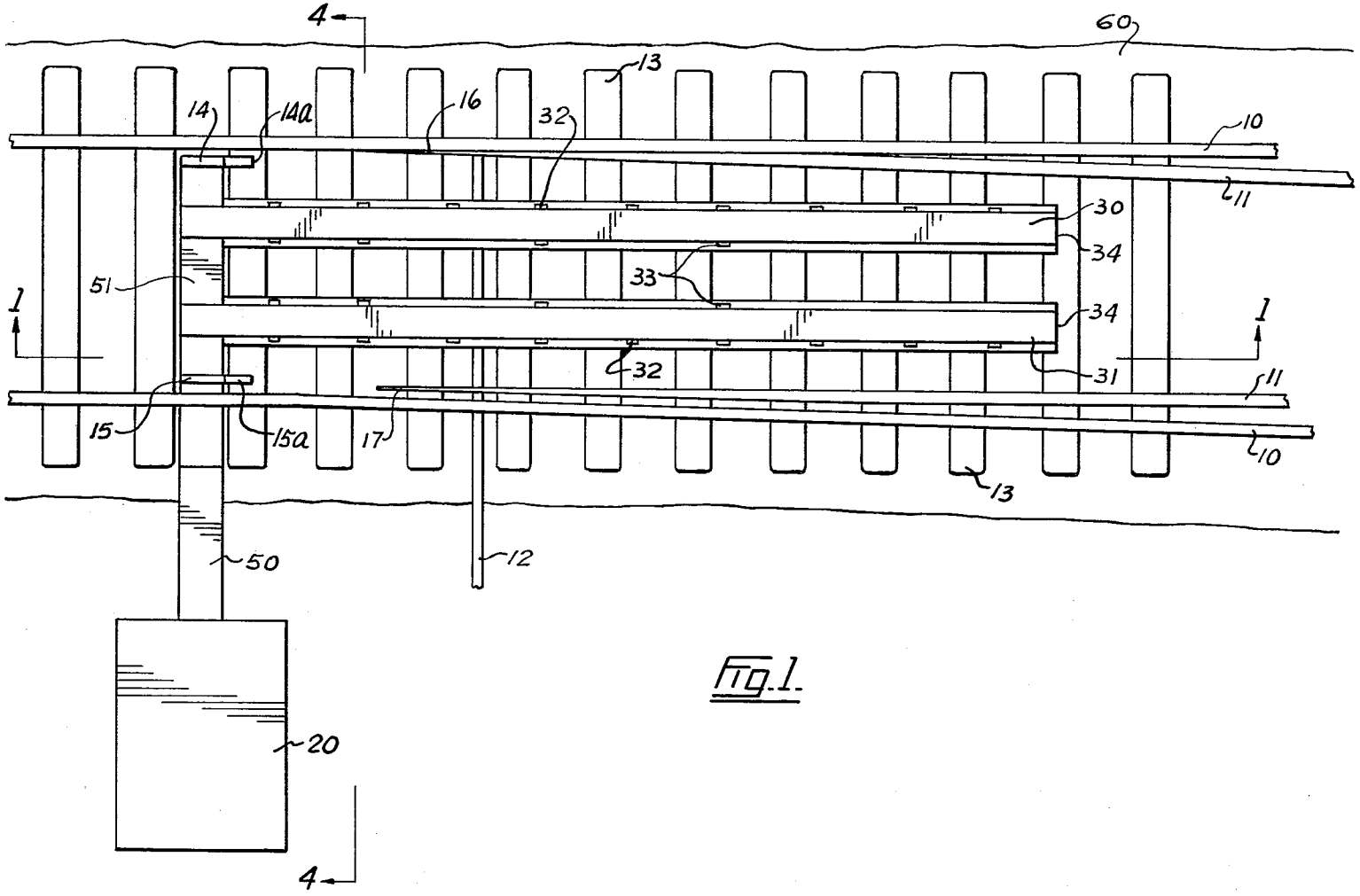
FIG. 1 is a top plan view of a railway track at a switch location showing the novel switch heater system I have described herein.

Referring to FIG. 1, the fixed rails 10 are mounted on an arrangement of cross ties 13, as shown. The inner moving rail 11 are also supported on the cross ties 13 and are actuated by the switching mechanism 12, which moves the movable rails 11 at the switch points 14, 15. The mechanics of the switch mechanism are conventional and are not shown.

Figure 4:
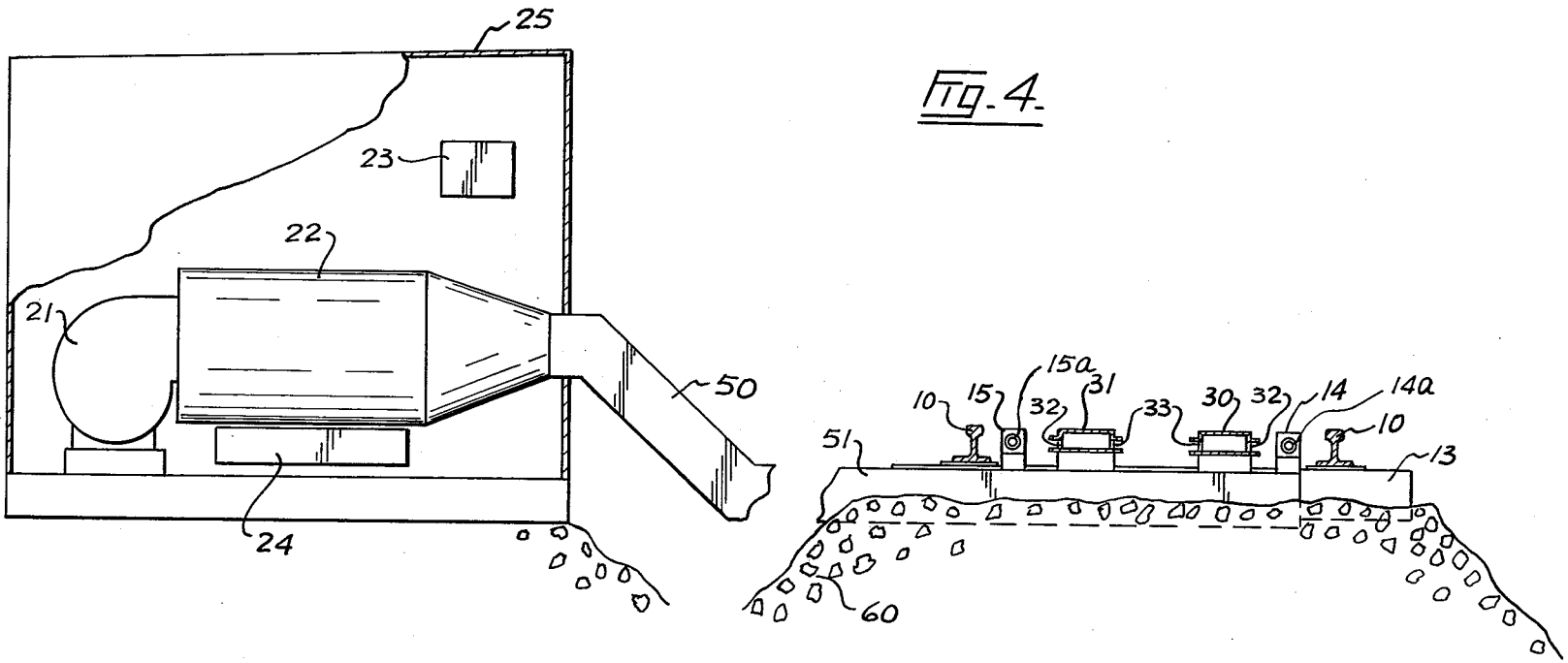
FIG. 4 is a cross-sectional view along line 4—4 of FIG. 1 showing the heat source and some of its components, the cross duct and the location of the rails with respect to the cross duct.

Provided at a position adjacent to the switch area of the tracks is a hot air source 20. The hot air source as shown in FIG. 4 consists of an enclosure 25 containing environmental controls 24, a fan 21, burner system 22, and control system 23.

Figure 2:
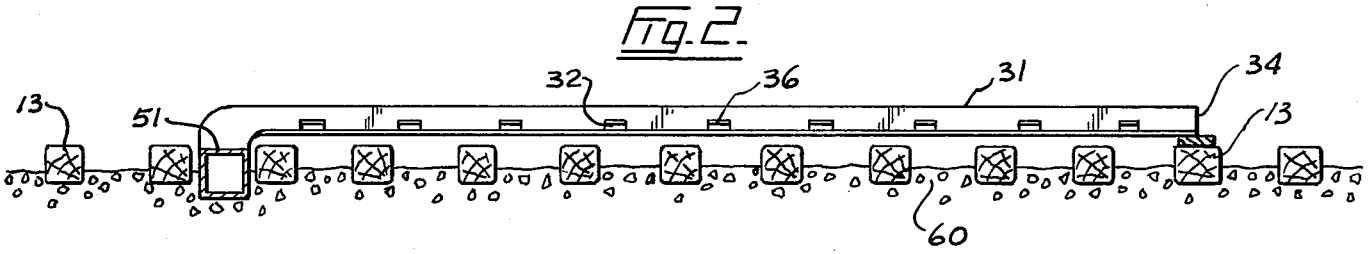
FIG. 2 is a cross sectional view of the system taken along line 1—1 of FIG. 1 showing the air discharge openings which are directed toward the moving tracks.
Figure 5:
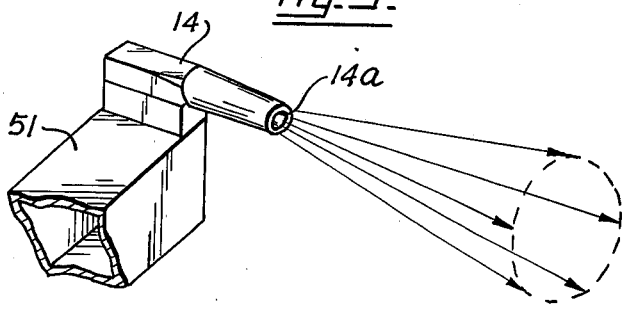
FIG. 5 is a perspective view showing one of the snorkels and its relation to the cross duct.
Figure 6:
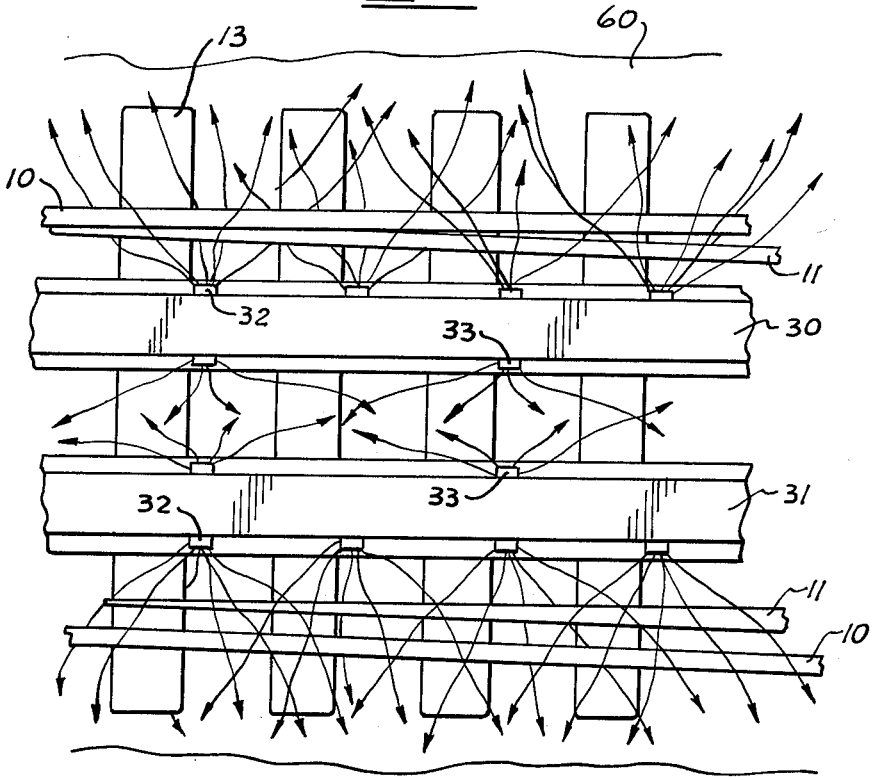
FIG. 6 is a plan view of a portion of the switch illustrating with arrows the distribution of the hot air.

As shown in FIGS. 1 and 2, forced hot air is supplied by the hot air source 20 and is directed through cross ducts 50, 51 to the distribution ducts 30, 31, and to snorkels 14, 15. The snorkels 14, 15 are provided with outlets **14*a*, 15*a* so oriented that the streams of hot air ejected from them are directed along the rails 10, 11, as shown in FIGS. 1 and 5. The distribution ducts 30, 31 are provided with closed ends 34 and with hot air distribution outlets 32 in their outer sides. The outlets 32 direct the streams of hot air toward and past the rails 10, 11, to the edge of the rail grade 60. Further, the distribution ducts 30, 31 are provided with hot air distribution outlets 33 on their inner sides for directing streams of hot air toward the central area of the rail grade 60**, between the parallel sets of rails.

Figure 3:
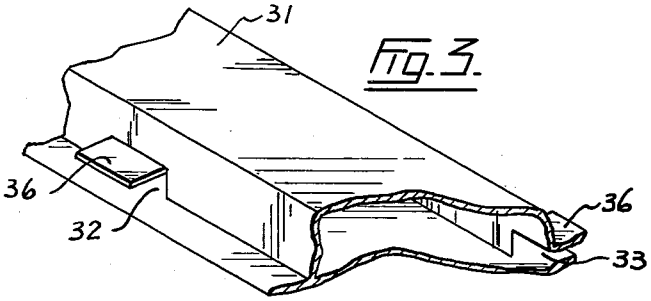
FIG. 3 is a fragmentary perspective view of a section of one of the discharge ducts showing an air discharge opening.

These hot air distribution outlets 32, 33 are rectangular openings in the distribution ducts 30, 31, as shown in FIGS. 2 and 3. The outlets 32, 33 are provided with deflectors 36 at their upper extremities, as shown in FIG. 3, to cause the air to follow a flat, fan-like pattern.

The hot air source 20 is preferably selected to provide about 1500 cubic feet per minute of air at about 250° F at a static pressure of about one inch water column. This flow of hot air is directed to the hot air distribution outlets 32, 33 and snorkels 14, 15, from which it is ejected at a velocity of about 3,000 feet per minute. I have found that blasts of hot air of these proportions are needed to melt the snow and ice and clear the water formed away from the full width of the switch grade 60.

What is claimed is:

1. A heater system for a railroad switch having a pair of fixed outer rails and a pair of inner movable rails therebetween mounted on an arrangement of ties on a switch grade, each of said movable rails having a switch point, said heater system comprising:

means adjacent the switch for supplying forced hot air;

a cross duct extending from the hot air means beneath the adjacent outer and inner rails;

longitudinally extending distribution ducts mounted on the ties between and adjacent the movable rails;

means connecting said distribution ducts to said cross duct for the supply of said hot air thereto;

each of said distribution ducts having a plurality of openings provided in both of its sides and spaced along and throughout the longitudinal extent thereof for dispensing hot air transversely outwardly toward the rails and the end portions of the ties as well as directly transversely inwardly toward and across the central portion of the switch grade between the rails;

said entire system, except for said hot air supply means and said cross duct, being disposed entirely and solely between and interiorly of said outer rails, and wherein the spaces defined between adjacent ties within the vicinity of said movable and fixed rails are longitudinally unobstructed so as to permit said outwardly transversely dispensed hot air to flow freely through said spaces beyond said end portions of said ties; and said hot air supply means being selected so as to provide a sufficient volume of hot air at a sufficient velocity at the duct openings so as to melt the snow and ice on the switch grade and to forcefully clear the produced water outwardly beyond said outer rails and from the grade across the entire length of the ties.

2. The heater system as set forth in claim 1 comprising:

a pair of spaced snorkels connected with the cross duct and positioned to direct hot air longitudinally along the switch points.

3. The heater system as set forth in claim 1 comprising:

said hot air supply means being capable of providing at least about 1300 cubic feet per minute of air at a temperature of at least 250° F at the inlet to the cross duct and at a pressure in excess of one inch water column in the distribution ducts, said ducts and openings being sized and spaced to ensure that the air leaves the openings in overlapping patterns.

4. A method for clearing a railroad switch of ice, snow, and water by use of a hot air system, said switch having a pair of fixed outer rails and a pair of inner movable rails therebetween mounted on an arrangement of ties on a switch grade, the spaces defined between adjacent ties within the vicinity of said movable and fixed rails being longitudinally unobstructed, which comprises the steps of:

supplying for a prolonged period of time at least 1300 cubic feet per minute of hot air at a pressure in excess of one inch water column to parallel distribution ducts extending in a direction parallel with and between the rails;

providing said ducts with apertures in both of its sides and spaced along and throughout the longitudinal extent thereof, and conducting said hot air through said apertures directly transversely inwardly toward and across the central portion of the switch grade between the rails and transversely outwardly toward rails and the end portions of said ties, through said unobstructed spaces of said tie arrangement in a free-flowing manner, and beyond said end portions of said ties, said apertures also being sized so that the air leaves the apertures at a velocity of at least 3000 feet per minute, so as to forcefully clear the produced water outwardly beyond said outer rails, whereby ice, snow, and water are removed from the grade across the entire length of the ties.

5. A heater system for a railroad switch having a pair of fixed outer rails and a pair of inner movable rails therebetween mounted on an arrangement of ties on a switch grade, each of said movable rails having a switch point, said heater system comprising:

duct means longitudinally mounted on the ties between and adjacent to the movable rails;

distributing means in said duct means for directing a flow of air transversely outwardly toward the rails and directly transversely inwardly toward and across the central portion of the switch grade between the rails;

said entire system being disposed entirely and solely between and interiorly of said inner rails, and wherein the spaces defined between adjacent ties within the vicinity of said movable and fixed rails are longitudinally unobstructed so as to permit said outwardly transversely directed air to flow freely through said spaces beyond the end portions of said ties; and means supplied through said duct means and said distribution means for forcefully clearing ice, snow, and water from said switch grade along the full length of said ties and outwardly beyond said outer rails.

6. The heater system of claim 5, wherein said clearing means is forced hot air.

7. The heater system of claim 6 also including means exterior of the switch for supplying the forced hot air and for conducting the forced hot air from said supplying means to said duct means.

8. The heater system of claim 7 wherein said distribution means includes snorkel means for guiding said forced hot air longitudinally along the switch points.

9. The heater distribution system of claim 7, wherein said distribution means includes orifice means sized and shaped for overlapping the flow of air.

* * * * *